United States Patent [19]

Bach et al.

[11] 4,403,733

[45] Sep. 13, 1983

[54] TRACK ASSEMBLY FOR TOY TRAINS

[75] Inventors: Erik Bach; Jan Ryaa, both of Billund, Denmark

[73] Assignee: Interlego A.G., Switzerland

[21] Appl. No.: 285,098

[22] PCT Filed: Dec. 15, 1980

[86] PCT No.: PCT/DK80/00080

§ 371 Date: Jul. 22, 1981

§ 102(e) Date: Jul. 22, 1981

[87] PCT Pub. No.: WO81/01799

PCT Pub. Date: Jul. 9, 1981

[30] Foreign Application Priority Data

Dec. 20, 1979 [DK] Denmark ..... 5465/79

[51] Int. Cl.[3] ..... E01B 23/00; A63H 33/00

[52] U.S. Cl. ..... 238/10 E; 46/1 K

[58] Field of Search ..... 46/1 K, 16, 216, 43, 46/25; 238/10 E, 10 A, 10 R

[56] References Cited

U.S. PATENT DOCUMENTS

| | | | |
|---|---|---|---|
| 1,828,536 | 10/1931 | Koerber | 238/10 E X |
| 3,220,141 | 11/1965 | Goss | 46/25 |
| 3,464,624 | 9/1969 | Christiansen | 238/10 E |
| 3,581,987 | 6/1971 | Tomaro | 46/216 X |

FOREIGN PATENT DOCUMENTS

| | | | |
|---|---|---|---|
| 37011 | 4/1965 | Fed. Rep. of Germany | 46/1 K |

*Primary Examiner*—Mickey Yu

*Attorney, Agent, or Firm*—Kane, Dalsimer, Kane, Sullivan and Kurucz

[57] ABSTRACT

A track for toy trains is made by detachably connecting a plurality of rail elements having lengthwise extending rail-forming ribs with tie elements provided with connecting members adapted to be clamped into cavities in the bottom of the rails adjacent the ends thereof, so as to provide a sort of snap-locking device, including :

in the rails: a lengthwise extending cavity (12) in the bottom of the rails defined by side walls (15) and end walls (16). In the bottom of the cavity (12) adjacent the end walls (16) there is provided an aperture (13) which communicates with another aperture (14) extending transversely through the rib (11) on the top face of the rail, and in the ties; pairs of upwardly extending spring clips (21) interspaced at a distance corresponding to the gauge of the track and having a socket (22) fitting into the cavity (12) of the rails, a pair of upwardly extending, resiliently deformable tongues (23) provided with outwardly projecting flanges (24), the lower faces (24) of which are adapted to engage the upper face (10*a*) of the rails, when the sockets (22) are plugged into the cavities (12) of the rails.

2 Claims, 14 Drawing Figures

TRACK ASSEMBLY FOR TOY TRAINS

Figure 1:
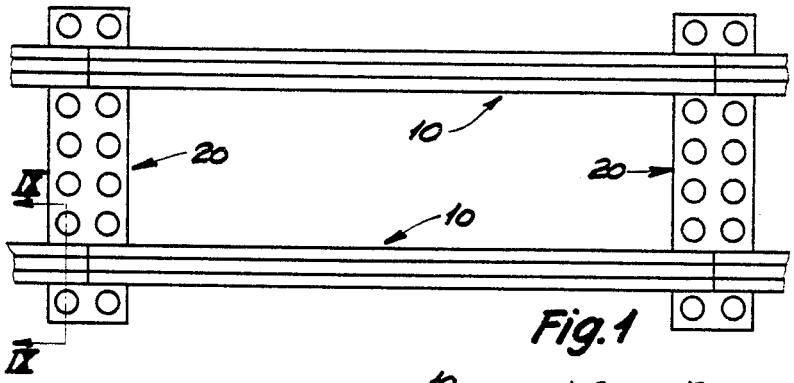

This invention relates to tracks for toy trains and, more particularly, to a track assembly comprising a plurality of rails and ties made by injection moulding of a thermoplastic material and provided with coupling means for detachably mounting the ends of the rails on the ties.

Prior art in this field is disclosed in U.S. Pat. No. 3,464,624 which describes a track assembly comprising, on the one hand, a plurality of rails in the form of elongated, substantially rod-shaped elements having a longitudinally extending rail-forming rib integral with the upper face of the rail element and a longitudinally extending cavity in the bottom of the rail and, on the other hand, a plurality of ties in the form of rectangular plate elements provided with upwardly extending coupling studs adapted to engage complementary coupling studs located in the cavity of the rails adjacent the ends thereof. In this track assembly, the rails are detachably mounted on the ties by interlocking a pair of the studs on the top face of the ties with the studs in the cavities in the rails and with the side and end walls adjacent the cavities at the ends of the rails.

The present invention constitutes an improvement of this prior art, and the main object of the invention is to provide improved coupling means between the rails and the ties, so as to obtain an increased coupling effect by providing a sort of snap-locking device.

A further object of the invention is to enable the assembly and disassembly of the components to be made easy and convenient for children playing with a building set comprising such rail and tie elements.

According to the invention, these improvements are achieved by modifying the rail and tie elements of prior art, so as to comprise the combination of the following features:

(a) in the rails: an aperture (bottom aperture) in the bottom of the cavity adjacent either end of the rail and another aperture (rib aperture) extending transversely through the rib and communicating with the bottom aperture, (b) on the ties: at least one pair of upwardly extending spring clips spaced apart at a distance corresponding to the rail gauge of the track, each of said spring clips comprising a socket having a width substantially equal to the width of the cavity in the rails and a pair of upwardly extending and resiliently deformable tongues adapted to be received in the rib aperture, when the socket is pressed into the cavity of the rails for detachably interlocking the ties with the rails.

In a preferred embodiment of the invention, there is provided a tie element which is characterized by the features that the upper ends of the resiliently deformable tongues are provided with outwardly extending projections adapted to engage the upper face of the rails, adjacent opposite edges of the bottom aperture, when the sockets of the spring clips are pressed into the cavity of the rails for detachably interlocking the ties with the rails.

Another embodiment of the tie element according to the invention, wherein the bottom face is provided with side and end walls defining a cavity comprising a plurality of coupling studs for detachably mounting the tie element on complementary studs on the top face of a supporting structure, is characterized in that at least one of the side walls is provided with a longitudinally extending recess adjacent the bottom edge thereof for enabling the tie to be mounted in an inclined position relatively to a horizontal top face of a tie supporting structure having upwardly extending coupling studs adapted to engage the coupling studs in the cavity of the tie.

Figure 2:
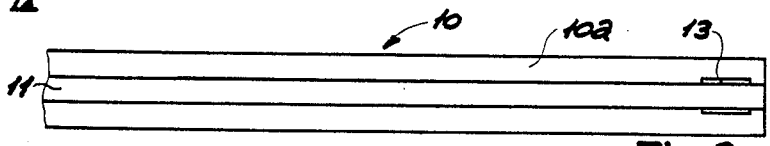
Figure 3:
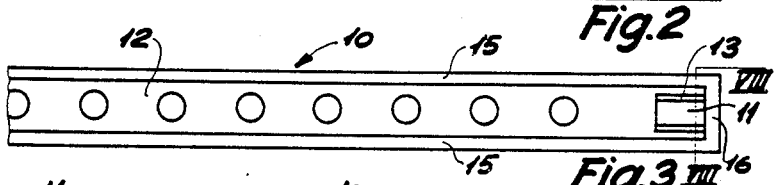
Figure 4:
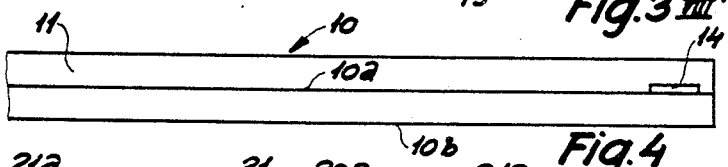
Figure 5:
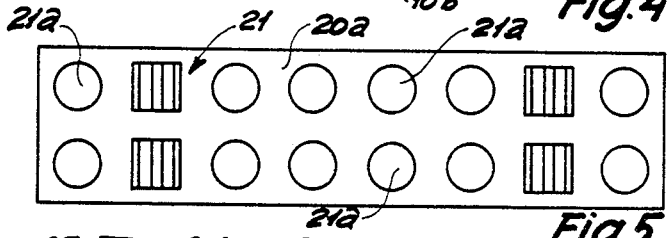
Figure 6:
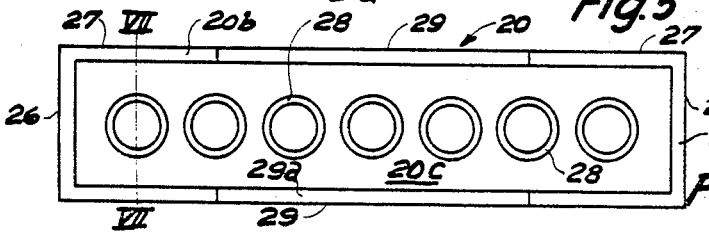
Figure 7:
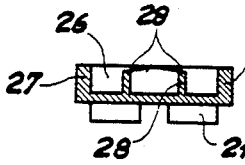
Figure 8:
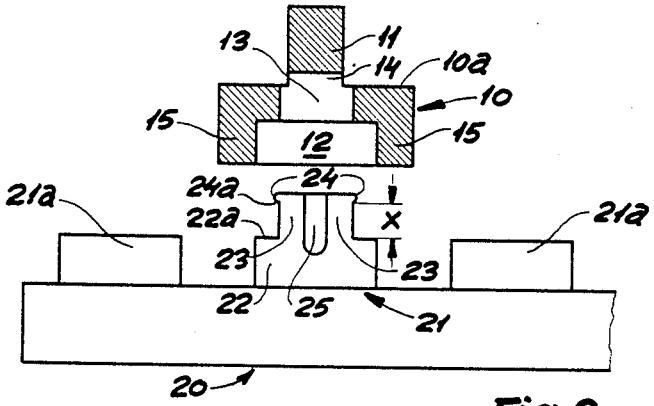
Figure 9:
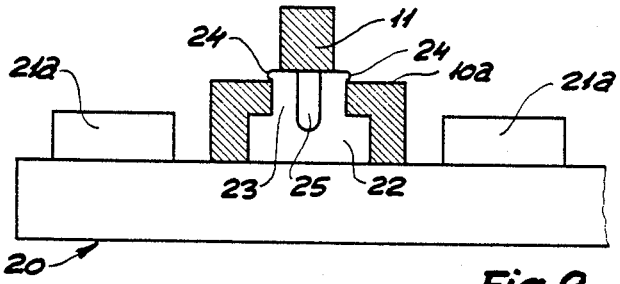
Figure 10:
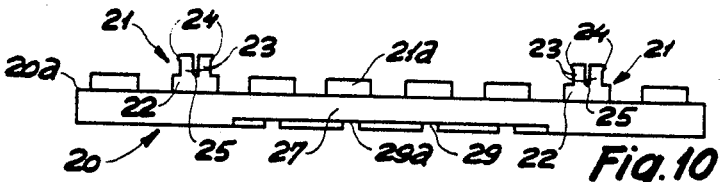
Figure 11:
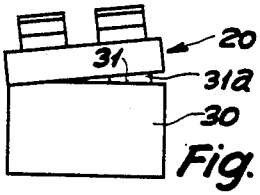
Figure 12:
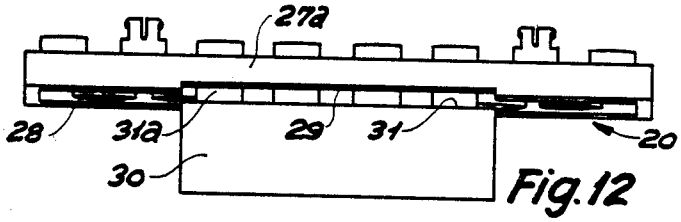
Figure 13:
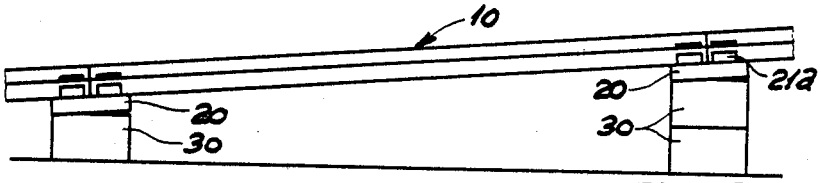
Figure 14:
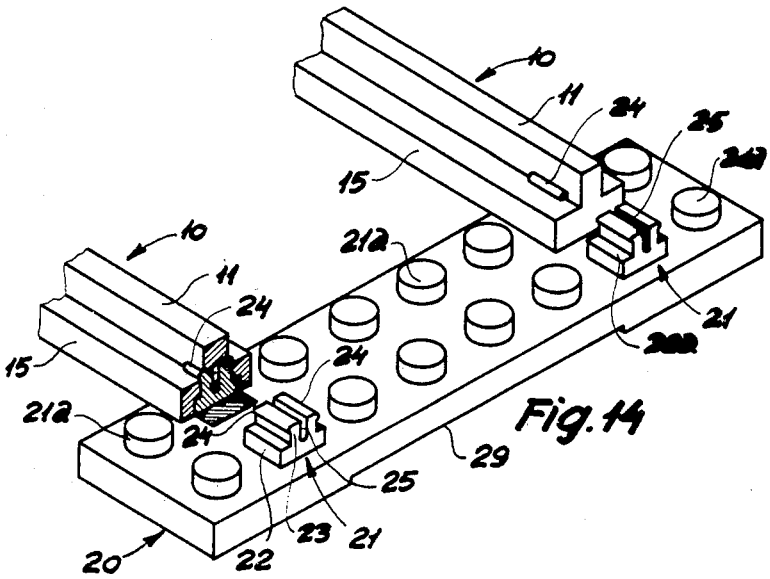

The details of the invention will now be explained with reference to the accompanying drawings, wherein FIG. 1 shows a plan view of a track assembly, FIGS. 2, 3 and 4 show a rail element according to the invention viewed from above, from below and from one side, respectively, FIGS. 5 and 6 show a tie element according to the invention viewed from above and from below, respectively, FIG. 7 presents a section along the line VII—VII in FIG. 6, FIG. 8 is an enlarged section of a rail element along the line VIII—VIII in FIG. 3 in a position above one side of a part of a corresponding tie element, FIG. 9 shows an enlarged section of the interconnected rail and tie elements of FIG. 8 along the line IX—IX in FIG. 1, FIG. 10 is a side view of the tie element shown in FIGS. 5, 6 and 7, FIG. 11 is an end view of the tie element mounted in an inclined position relatively to a horizontal top face of a supporting structure, FIG. 12 is a side view of the tie element and supporting structure in FIG. 11, FIG. 13 shows a part of a track assembly provided with a gradient, and FIG. 14 is a perspective end view of a pair of rail elements mounted on a tie element, wherein one of the rail elements is shown partly in section.

The track assembly shown in FIG. 1 comprises a pair of rails generally designated as 10 and a pair of ties generally designated as 20. The rails are detachably mounted on the ties by coupling means according to the invention which, however, are not visible in FIG. 1. They will appear from the following description with reference to FIGS. 2–14, in particular from the description of FIG. 9, which is a section along the line IX—IX in FIG. 1.

In FIGS. 2, 3 and 4 there is shown one end of a rail element according to the invention comprising an elongated, substantially rod-shaped body 10 having an upper face 10*a* and a bottom face 10*b*. A rail-forming rib 11 integral with the upper face 10*a* extends in the lengthwise direction of the rail, and the bottom face 10*b* is provided with side walls 15 and end walls 16 defining a lengthwise extending cavity 12. In the bottom face of this cavity adjacent the end wall 16 there is provided an aperture 13, hereinafter referred to as the bottom aperture, and above this aperture the rib 11 is provided with an aperture, hereinafter referred to as the rib aperture 14, which extends transversely through the rib and communicates with the bottom aperture 13, as shown more specifically in FIG. 8. The bottom aperture 13 is preferably of rectangular shape, whereas the rib aperture 14 is a relatively narrow slit. The reasons for this configuration will be explained in the following with reference to the coupling means of the tie elements.

The tie elements shown in FIGS. 5–12 are made of rectangular plates 20 having a top face 20*a* and a bottom face 20*b* which is constituted by the lower end faces of end walls 26 and side walls 27. These walls define a cavity 20c which includes a row of tubular coupling studs 28 adapted to be clamped in between two pairs of cylindrical coupling studs 21a on the top face 20a of the plate element 20. The side walls 27 are provided with lengthwise extending recesses 29, the function of which will be explained with reference to FIGS. 10–13.

On the top face 20a of the ties 20 there is provided two rows of cylindrical coupling studs 21a and two pairs of upwardly extending spring clips 21 spaced apart at a distance corresponding to the rail gauge of the track. Each of these spring clips consists of a foot or socket 22 integral with a pair of upwardly extending and resiliently deformable tongues 23 separated by a narrow slit 25 and provided with outwardly extending projections 24 at the upper ends of the tongues.

The coupling means for detachably interconnecting the ends of the rails with the ties co-operate in the manner most clearly shown in FIGS. 8 and 9.

As shown in FIG. 8, the rail element 10,11 is provided adjacent its end wall 16, see FIG. 3, with three intercommunicating cavities:

the lengthwise extending cavity 12 in the bottom of the rail, the bottom aperture 13, and the rib aperture or slit 14 extending transversely through the rib 11.

The spring clip 21 of the tie element comprises the coupling means 22,23,24 recited above, the width of the socket 22 being substantially equal to the width of the cavity 12 and the distance x between the lower face 24a of the projections 24 and the upper face 22a of the socket 22 being preferably equal to or slightly larger than the thickness of the bottom wall of the rail.

When connecting the rail element 10 with the tie element 20 by pressing the two elements together into the position shown in FIG. 9, the socket 22 will be firmly clamped in the cavity 12 between the end wall 16 and the side walls 15. At the same time, the projections 24, when passing through the bottom aperture 13, will cause the resiliently deformable tongues 23 to be compressed until the projections 24 have passed right through the bottom aperture 13 and reached the upper surface 10a of the rail. In this final position, the tongues 23 will again expand and cause the lower face 24a of the projections 24 to be firmly clamped against the top face 10a of the rail.

There is thus provided a greatly enhanced coupling effect due to the co-action of the socket 22 with the walls of the cavity 12, the lower faces 24a of the projections 24 with the top face 10a and—at least to a certain extent—the pressure of the sides of the tongues 23 against the walls of the bottom aperture 13.

In the embodiment shown in FIGS. 5–7 and 10–13, the tie element 20 is adapted to build a track having a gradient as shown in FIG. 10.

In prior art, as described in U.S. Pat. No. 3,464,624, such gradients required the rails to be shaped with inclined end faces. This complication is avoided by positioning the tie elements on their supports with an inclination relatively to the horizontal top faces of the supports. The feature which permits such constructions is the provision of the recess 29 in the bottom face 20b of the side walls 27, as shown in FIGS. 6, 10 and 12.

In these Figures, there is shown a tie element 20 which is disposed in an inclined position relatively to the horizontal top face 31 of a supporting structure 30, which may be a building block or a combination of building blocks in a toy building set. The top face 31 of this structure is provided with coupling studs 31a, which are identical with the studs 21a of the ties 20 and are adapted to engage the tubular studs 28 in the cavity 20c of the ties. As shown in FIG. 12, the length of the recesses 29 is substantially equal to or slightly larger than the length of the supporting structure 30, which enables the tie 20 to be tilted relative to the horizontal top face 31 of the structure 30 to a position wherein one edge of this face coincides with the bottom face 29a of the recess 29. In this inclined position of the tie 20 on the supporting structure 30, the coupling studs 31a will remain in engagement with the studs 28 although slightly displaced relatively thereto.

What is claimed is:

1. A track assembly for toy trains comprising a plurality of rails and ties having coupling means for detachably mounting the ends of the rails on the ties, wherein the rails are elongated, substantially rod-shaped elements having an upper face and a bottom face, a longitudinally extending rail-forming rib integral with the upper face and a longitudinally extending cavity in the bottom face, and wherein the ties are rectangular plate elements having a bottom face and a top face provided with upwardly extending coupling studs, characterized by the combination of the following features:

(a) in the rails: an aperture (bottom aperture) in the bottom of the cavity adjacent either end of the rail extending toward the rib and another aperture extending transversely through the rib (rib aperture) at the interface of said upper face and rib and communicating with the bottom aperture, (b) on the ties: at least one pair of upwardly extending spring clips spaced apart at a distance corresponding to the rail gauge of the track, each of said spring clips comprising a socket having a width substantially equal to the width of the cavity in the rails and a height corresponding to the depth of the cavity, and a pair of upwardly extending and resiliently deformable tongues spaced apart from each other a distance substantially equal to the width of the bottom aperture and a height substantially equal to the depth of the bottom aperture and adapted to be received in and fill the bottom aperture, said tongues terminating at their upper ends in outwardly extending projections which overlie said upper face whereby when the socket is pressed into the cavity said socket fills the cavity and said tongues fill said bottom aperture and said projections extend into said rib aperture and over said upper face for cooperating with said socket seating in said cavity for detachably interlocking the ties with the rails in a double locking action.

2. A tie element for a track assembly as claimed in claim 1, wherein the bottom face is provided with side and end walls defining a cavity comprising a plurality of coupling studs for detachably mounting the tie element on complementary studs on the top face of a supporting structure, characterized in that at least one of the side walls is provided with a longitudinally extending recess adjacent the bottom edge thereof for enabling the tie to be mounted in an inclined position relatively to a horizontal top face of a tie supporting structure having upwardly extending coupling studs adapted to engage the coupling studs in the cavity of the tie.

* * * * *